US012497838B1

(12) United States Patent
Du et al.

(10) Patent No.: US 12,497,838 B1
(45) Date of Patent: Dec. 16, 2025

(54) DRILLING METHOD FOR STORAGE WELL FOR LIQUID-GAS TWO-PHASE COMBINED GEOLOGICAL STORAGE

(71) Applicant: General Prospecting Institute of China National Administration of Coal Geology, Beijing (CN)

(72) Inventors: Song Du, Beijing (CN); Qiaohui Che, Beijing (CN); Degao Zhang, Beijing (CN); Yinglin Fan, Beijing (CN); Zhe Jiang, Beijing (CN); Xiao Zhang, Beijing (CN); Sitong Song, Beijing (CN); Yonghan Liu, Beijing (CN); Yan Ding, Beijing (CN)

(73) Assignee: General Prospecting Institute of China National Administration of Coal Geology, Beijing (CN)

( * ) Notice: Subject to any disclaimer, the term of this patent is extended or adjusted under 35 U.S.C. 154(b) by 0 days.

(21) Appl. No.: 19/216,811

(22) Filed: May 23, 2025

(30) Foreign Application Priority Data

Jun. 13, 2024 (CN) ..... 202410757169.5

(51) Int. Cl.
*E21B 7/20* (2006.01)

(52) U.S. Cl.
CPC ..... *E21B 7/20* (2013.01)

(58) Field of Classification Search
CPC . E21B 41/005; E21B 41/0057; E21B 41/0035
See application file for complete search history.

(56) References Cited

U.S. PATENT DOCUMENTS 1,518,370 A * 12/1924 Thomas ..... E21B 17/1078 175/325.5
2,070,370 A * 2/1937 Miller ..... E21B 17/1078 175/380
2,692,051 A * 10/1954 Webb ..... E21B 43/38 166/265
2004/0011523 A1* 1/2004 Sarada ..... E21B 41/0057 166/267

(Continued)

OTHER PUBLICATIONS

Schlumberger Oilfield Glossary https://glossary.slb.com/en/terms/w/wellbore Accessed 2025 (Year: 2025).*

*Primary Examiner* — David Carroll
(74) *Attorney, Agent, or Firm* — Bayramoglu Law Offices LLC

(57) ABSTRACT

Provided is a drilling method for a storage well for liquid-gas two-phase combined geological storage, including the following steps: drilling down from a ground to the bottom of a potable aquifer, and installing a first section wellbore; dividing a second section wellbore into multiple segments of second section sub-wellbores, arranging multiple first bases on an inner wall in advance, forming an vent hole in a sidewall of the second section sub-wellbore corresponding to a gas storage layer, and closing a bottom surface of the second section sub-wellbore at the bottom, with a drill-through hole at the center; drilling down to the bottom of the gas storage layer, and installing the second section wellbore; dividing a third section wellbore into multiple segments of third section sub-wellbores, and arranging multiple second bases on an outer wall in advance.

8 Claims, 4 Drawing Sheets

(56) References Cited

U.S. PATENT DOCUMENTS

2008/0035336 A1* 2/2008 Cognata ..... E21B 43/385
166/265
2009/0260826 A1* 10/2009 Sherwood ..... E21B 41/0057
166/305.1

* cited by examiner

DRILLING METHOD FOR STORAGE WELL FOR LIQUID-GAS TWO-PHASE COMBINED GEOLOGICAL STORAGE

CROSS-REFERENCE TO THE RELATED APPLICATIONS

This application is based upon and claims priority to Chinese Patent Application No. 202410757169.5, filed on Jun. 13, 2024, the entire contents of which are incorporated herein by reference.

TECHNICAL FIELD

The present disclosure belongs to the technical field of geological storage, and in particular to a drilling method for a storage well for liquid-gas two-phase combined geological storage.

BACKGROUND

Deep geological storage refers to storing gas or liquid into underground rock pores and micro-cracks at a depth of 1,500-3,500 meters below the earth surface through storage wells, such a depth ensures that the gas/liquid fluids are positioned outside the biosphere, and the sealing and degradation properties of the fourth-class environmental medium (deep geological environment) are utilized to prevent the sequestered fluids from participating in the material cycles of humans and living organisms. Deep geological storage is a safe environmental disposal method, which primarily involves the separate geological storage of gas or liquid in geological formations at present, followed by research on their subsurface migration and diffusion mechanisms. Moreover, the research on the foregoing aspects is relatively mature. However, there are few studies on gas-liquid mixed fluid or gas-liquid combined storage, for example, how to carry out gas-liquid combined storage of wastewater containing waste gas, and how to achieve combined storage of separate gas and liquid. At present, the main problems in this aspect are an unreasonable structure of a storage well, a sealing problem of the storage well, a problem of gas-liquid separation, and so on.

SUMMARY

For the problem above, the present disclosure provides a drilling method for a storage well for liquid-gas two-phase combined geological storage, including following steps:

S1: drilling down from a ground to a bottom of a potable aquifer, placing a first section well casing, and then carrying out cementing;

S2: dividing a second section well casing into multiple segments of second section sub-well casings, arranging multiple first bases on an inner wall of each of the multiple segments of second section sub-well casings for installing support rods between an inner wall of the second section well casing and an outer wall of a third section well casing, where a sidewall of a second section sub-well casing, corresponding to a gas storage layer, of the multiple segments of second section sub-well casings is uniformly provided with multiple vent holes for venting gas injected from the second section well casing into the gas storage layer; and a bottom surface of a second section sub-well casing, at a bottom, of the multiple segments of second section sub-well casings is closed and is provided with a drill-through hole at a center of the bottom surface for the third section well casing to pass through;

S3: continuing to drill down through the first section well casing to a bottom of the gas storage layer, then placing the second section well casing in the first section well casing, wherein the second section well casing extends to the bottom of the gas storage layer from the ground;

S4: dividing the third section well casing into multiple segments of third section sub-well casings, and arranging multiple second bases on an outer wall of each of the multiple segments of third section sub-well casings for installing the support rods, where a gas-liquid separation component is arranged in any one of third section sub-well casings, at an upper portion of the third section well casing, of the multiple segments of third section sub-well casings for gas-liquid separation of liquid injected from the third section well casing; a sidewall of one, corresponding to a liquid storage layer, of the multiple segments of third section sub-well casings is uniformly provided with multiple drain holes for draining the liquid injected from the third section well casing into the liquid storage layer;

S5: continuing to drill down through the second section well casing to a bottom of the liquid storage layer, then placing the third section well casing in the second section well casing, wherein the third section well casing extends to the bottom of the liquid storage layer from the ground, and outside a position where the third section well casing penetrates the drill-through hole, an outer wall of the third section well casing and an edge of the drill-through hole are sealed with mud;

corresponding the multiple second bases on the outer wall of each of the multiple segments of third section sub-well casings one-to-one with the multiple first bases, and then installing the support rods; and S6: closing a top of the second section well casing, and reserving a position for a top of the third section well casing and at least one wellhead of the second section well casing; closing the top of the third section well casing, and reserving a position for a wellhead of the third section well casing.

In some embodiments, each of the first bases comprises a first base sleeve and a first hanging ring. The first base sleeve is a hollow cylinder. An axial direction of the first base sleeve is perpendicular to an inner wall of a corresponding one of the multiple segments of second section sub-well casings. One end of the first base sleeve is provided with a circle of skirt edge extending vertically outwards. The circle of skirt edge is able to be attached to the inner wall of a corresponding one of the multiple segments of second section sub-well casings and is fastened to the inner wall of the corresponding one of the multiple segments of second section sub-well casings by bolts, thereby fastening the first base sleeve; and the first hanging ring is inside the first base sleeve and is installed on the inner wall of the corresponding one of the multiple segments of second section sub-well casings.

A formation depth of the gas storage layer is less than formation depth of the liquid storage layer, and a length of the second section well casing is less than a length of the third section well casing.

In step S3, a drill bit is drilled to the bottom of the gas storage layer, and a circular platform which is horizontal is formed at the bottom of the gas storage layer.

The second section sub-well casing at the bottom has a circular bottom surface and is correspondingly placed on the circular platform at the bottom of the gas storage layer.

A diameter of a drill bit adopted in step S3 is greater than that a diameter of a drill bit adopted in step S5. In steps S3 and S5, the second section well casing is concentrically arranged with the third section well casing and the first section well casing.

The drill bit adopted in step S5 starts to drill down from the drill-through hole of at the bottom surface of the second section sub-well casing at the bottom to the bottom of the liquid storage layer. A gap between an outer wall of the third section sub-well casing corresponding to the drill-through hole and an edge of the drill-through hole is sealed with the mud to prevent the gas in the second section well casing from leaking from the gap, and the third section well casing is also able to be reinforced and supported at the drill-through hole.

In some embodiments, a structure of the second base is the same as that of the first base. Specifically, each of the multiple second bases comprises a second base sleeve and a second hanging ring, the second base sleeve is a hollow cylinder. An axial direction of the second base sleeve is perpendicular to an inner wall of a corresponding one of the multiple segments of third section sub-well casings. One end of the second base sleeve is provided with a circle of skirt edge extending vertically outwards, the circle of skirt edge is able to be attached to an outer wall of the corresponding one of the multiple segments of third section sub-well casings and is fastened to the outer wall of the corresponding one of the multiple segments of third section sub-well casings by bolts, thereby fastening the second base sleeve; and the second hanging ring is inside the second base sleeve and is installed on the outer wall of the corresponding one of the multiple segments of third section sub-well casings.

In some embodiments, the gas-liquid separation component is a helical flow tube which surrounds an inner wall of the third section well casing in a helical pattern for multiple turns, and a top of each turn of the helical flow tube is provided with a hollowed-out vent slot for venting gas after gas-liquid separation, and the vent slot is arranged along the helical flow tube.

A liquid delivery pipe is arranged at a wellhead of the third section well casing, which extends from the ground to a top of the helical flow tube and is connected with a water inlet at the top of the helical flow tube. Liquid on the ground is input into the helical flow tube through the liquid delivery pipe and then flows downward along the helical flow tube, and a centrifugal force which is conducive to gas-liquid separation is generated. Separated gas is discharged from the vent slot, rises to an upper portion of the third section well casing, and then is discharged from the top of the third section well casing. A bottom end of the helical flow tube is open for the liquid to be drained into the third section well casing continuously. There are several support rods on the side, adjacent to the inner wall of the third section well casing, of the helical flow tube, which fix the helical flow tube on the inner wall of the third section well casing.

A method for arranging the support rod is as follows:

(1) after cementing the second section well casing in step S3, configuring a traction rope for each of the support rods, respectively installing hooks at both end of the traction rope for connecting the first hanging ring and the second hanging ring, arranging a reel at a middle of the traction rope for temporarily adjusting a length of the traction rope;

(2) installing a manipulator at a bottom end of a retractable rod, and moving the retractable rod to a position right above the first base to be operated, holding, by the manipulator, a hook, at one end of the traction rope, of the hooks, and descending the manipulator to the first base along with the retractable rod, and hanging, by the manipulator, the hook into the first hanging ring;

connecting corresponding traction ropes to the multiple first bases on the inner wall of the second section well casing according to a method in step (2);

(3) in step S5, enabling the multiple second bases on an outer wall of each of the multiple segments of third section sub-well casings to correspond to the multiple first bases one by one, specifically, before hoisting a certain third section sub-well casing of the multiple segments of third section sub-well casings, hanging an other hook of the traction rope of a corresponding one of the multiple first bases on the second hook of a corresponding one of the multiple second bases;

then hoisting the multiple segments of third section sub-well casings into the second section well casing to connect one, that has been installed and positioned below, of the multiple segments of third section sub-well casings, wherein under traction and guidance of the traction rope, a correct orientation is able to be maintained when lowering the multiple segments of third section sub-well casings, making the multiple second bases correspond to the multiple first bases one by one; and after installing all the multiple segments of third section sub-well casings according to a method in step (3), removing all the hooks corresponding to the multiple second bases by the manipulator and the retractable rod according to the method in step (2), recovering one end of the traction rope corresponding to a corresponding one of the multiple second bases to the ground to form a free end, and then cementing the third section well casing;

(4) dividing each of the support rods into multiple sub-rods, wherein each of the multiple sub-rods is a hollow barrel, and enabling the free end of the traction rope to run through a corresponding one of the multiple the sub-rods in an axial direction of the corresponding one of the multiple sub-rods to hoist the corresponding one of the multiple sub-rods to the corresponding one of the multiple first bases along the traction rope;

(5) lowering remaining sub-rods of the multiple sub-rods to adjacent sub-rod that have been connected in turns along the traction rope according to a method of step (4), and connecting the multiple sub-rods in turn; and (6) lowering a last sub-rod in place along the traction rope according to the method of step (4), after leveling the last one of the multiple sub-rods, gripping, by the manipulator, the last sub-rod to insert one end, away from the corresponding one of the multiple the second bases, of the last sub-rod into an open end of the adjacent sub-rod, then cutting off a hoisting rope and the traction rope of the last sub-rod, and inserting an other end of the last sub-rod into the second base sleeve of the corresponding one of the multiple second bases, and finally riveting or welding both ends of the last sub-rod to the second base sleeve and the adjacent sub-rod.

Each of the support rods is installed from bottom to top according to the method described above.

In some embodiments, in step (3), the multiple second bases and the multiple first bases are connected and positioned by the traction rope to avoid rotation dislocation of the third section sub-well casing in the hoisting process. In the process of descending the multiple segments of third section sub-well casings, the reel gradually retracts to make the traction rope gradually shortened, thereby preventing the traction rope from prolapsing and making the traction rope always kept in a tight state.

In some embodiments, in step (4), the free end of the traction rope is hung on a hoisting device, a top of each of the multiple sub-rods is temporarily connected with the hoisting device by at least two hoisting ropes, and the manipulator is pre-positioned by the retractable rod to a position beside the multiple first bases to be connected.

The hoisting device releases the sub-rod gradually. The sub-rod falls to a position beside the multiple first bases along the traction rope. The hoisting device moves towards a center of circle of the second section well casing on the ground, making a part of a root (that is a portion adjacent to the first base) of the traction rope horizontal, and the sub-rod is also in a horizontal posture with the traction rope.

A gripper of the manipulator grips the sub-rod to insert the sub-rod into the first base sleeve of a corresponding one of the multiple first bases, then the first base sleeve and the sub-rod are riveted or welded, and the hoisting rope connected with the sub rod is cut off by the manipulator.

In some embodiments, in step S6, the top of the third section well casing is closed with a well lid or cement, and a position for the liquid delivery pipe and a position for a vent pipe is reserved. The liquid delivery pipe is arranged adjacent to the inner wall of the third section well casing. One end of the vent pipe communicates with an inside of the third section well casing, and an other end of the vent pipe is connected with a gas delivery pipe to input separated gas in the third section well casing into the second section well casing.

In some embodiments, in step S6, the top of the second section well casing is closed with cement or a cover plate to achieve a sealing effect, thereby preventing the gas in the second section well casing from overflowing.

Figure 1:
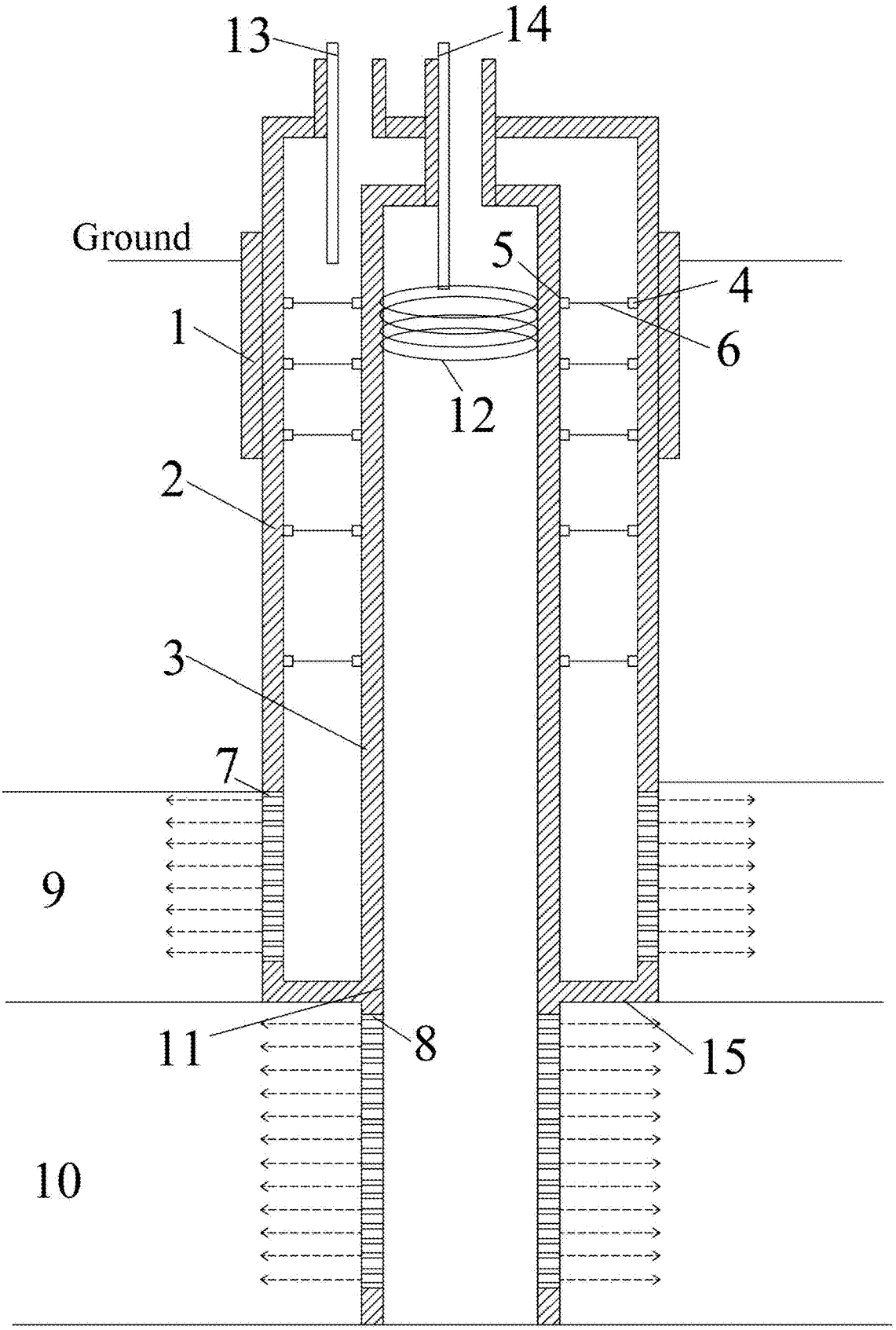
FIG. 1 is a structural diagram of a storage well in an embodiment.

List of the reference characters: 1 first section well casing; 2 second section well casing; 3 third section well casing; 4 first base; 5 second base; 6 support rod; 7 vent hole; 8 drain hole; 9 gas storage layer; 10 liquid storage layer; 11 drill-through hole; 12 gas-liquid separation component; 13 gas delivery pipe; 14 liquid delivery pipe; 15 circular platform; 16 vent slot; 17 traction rope; 18 reel; 19 sub-rod; 20 manipulator; and 21 retractable rod.

DETAILED DESCRIPTION OF THE EMBODIMENTS

Figure 2:
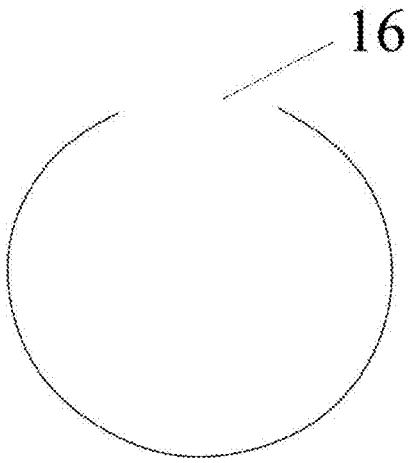
FIG. 2 is a sectional diagram of a helical flow tube.
Figure 3:
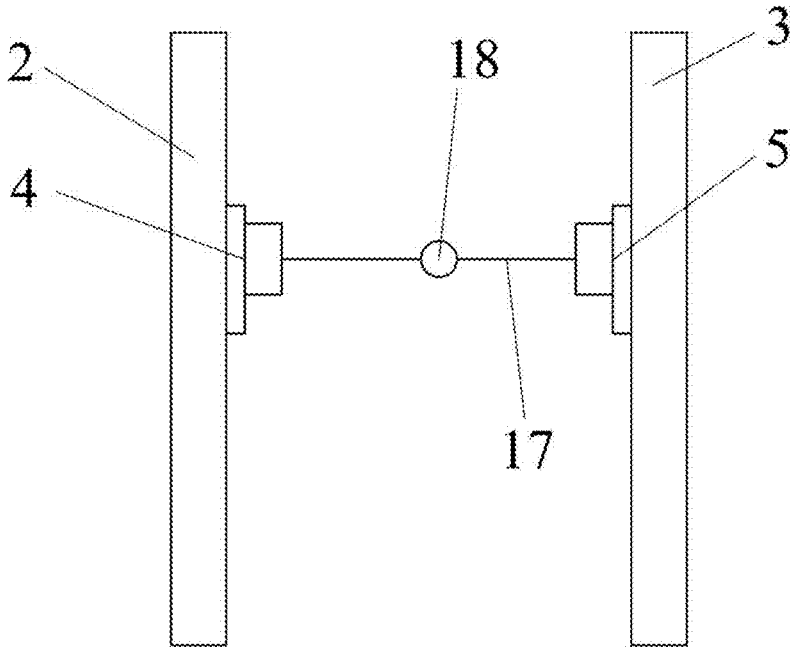
FIG. 3 is a diagram of a first base and a second base which are aligned with each other.
Figure 4:
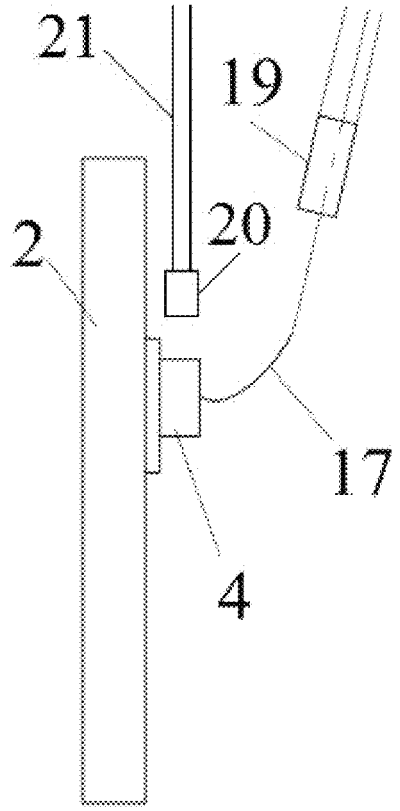
FIG. 4 is a diagram showing hoisting of a sub-rod.
Figure 5:
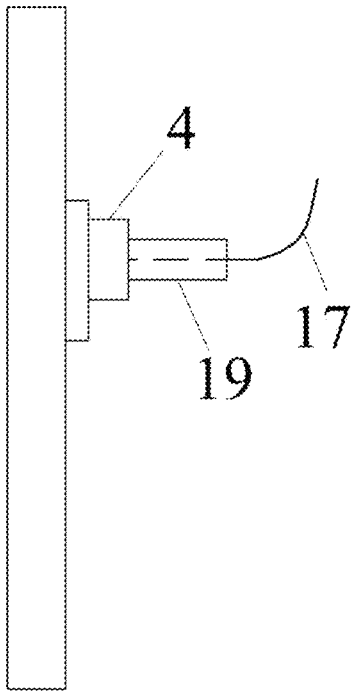
FIG. 5 is a diagram of the sub-rod and the first base which are butted with each other.
Figure 6:
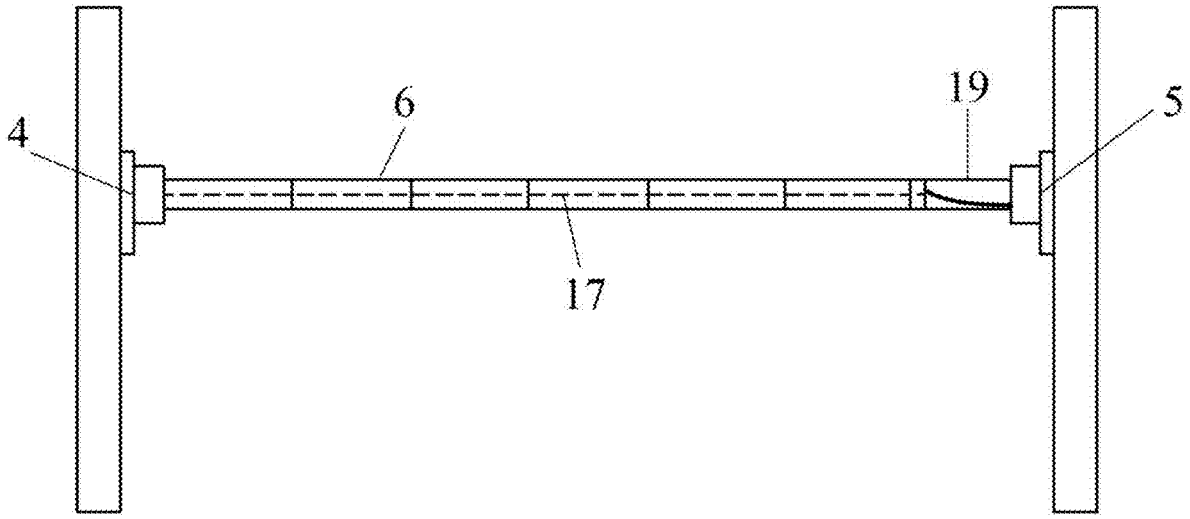
FIG. 6 is a diagram of a last sub-rod and the second base which are butted with each other.

The present disclosure provides a drilling method for a storage well for liquid-gas two-phase combined geological storage, as shown in FIG. 1 to FIG. 6, including the following steps.

In S1, it is drilled down from a ground to the bottom of a potable aquifer, then a first section well casing 1 is placed, and then cementing is carried out;

In S2, a second section well casing 2 is divided into multiple segments of second section sub-well casings, multiple first bases 4 are arranged on an inner wall of the second section sub-well casing in advance for installing support rods 6 between an inner wall of the second section well casing 2 and an outer wall of a third section well casing 3.

A sidewall of the second section sub-well casing corresponding to a gas storage layer 9 is uniformly provided with multiple vent holes 7 for venting a gas injected from the second section well casing 2 into the gas storage layer 9. A bottom surface of the second section sub-well casing at the bottom is closed and is provided with a drill-through hole 11 at the center of the bottom surface for the third section well casing 3 to pass through.

In S3, it is continued to drill down through the first section well casing 1 to the bottom of the gas storage layer 9, then the second section well casing is placed in the first section well casing 1. The second section well casing 2 extends to the bottom of the gas storage layer 9 from the ground.

In S4, the third section well casing 3 is divided into multiple segments of third section sub-well casings, and multiple second bases 5 are arranged on an outer wall of the third section sub-well casing in advance for installing the support rods 6.

A gas-liquid separation component 12 is arranged in any one of third section sub-well casings at an upper portion of the third section well casing 3 for gas-liquid separation of liquid injected from the third section well casing 3. A sidewall of the third section sub-well casing corresponding to the liquid storage layer 10 is uniformly provided with multiple drain holes 8 for draining the liquid injected from the third section well casing 3 into the liquid storage layer 10.

In S5, it is continued to drill down through the second section well casing 2 to the bottom of the liquid storage layer 10, then the third section well casing 3 is placed in the second section well casing 2. The third section well casing 3 extends to the bottom of the liquid storage layer 10 from the ground, and outside a position where the third section well casing 3 penetrates the drill-through hole 11, the outer wall of the third section well casing 3 and an edge of the drill-through hole 11 are sealed with mud.

The second bases 5 on the outer wall of the third section sub-well casing are in one-to-one correspondence with the first bases 4, and then the support rods are installed 6.

In S6, the top of the second section well casing 2 is closed, and a position for the top of the third section well casing and at least one wellhead of the second section well casing is reserved. The top of the third section well casing is closed, and a position for a wellhead of the third section well casing reserved.

A drilling technology in steps S1, S3 and S5 is the prior art. In step S1, a length of the first section well casing 1 is relatively short, which may be a whole section of well casing, or may be formed by vertically connecting multiple segments of first section sub-well casings. Cementing is the prior art, that is, an outer wall of the first section well casing 1 is protected and sealed with the mud to fasten a position of the first section well casing 1.

In some embodiments, the first base 4 includes a first base sleeve and a first hanging ring. The first base sleeve is a hollow cylinder. An axial direction of the first base sleeve is perpendicular to the inner wall of the second section sub-well casing. One end of the first base sleeve is provided with a circle of skirt edge extending vertically outwards. The skirt dage can be attached to the inner wall of the second section sub-well casing and is fastened to the inner wall of the second section sub-well casing by bolt. thereby fastening the first base sleeve. The first hanging ring is in the first base sleeve and installed on the inner wall of the second section sub-well casing.

In step S2, a length of the second section well casing 2 is relatively long, which is divided into multiple segments of second section sub-well casings connected up and down. A formation depth of the gas storage layer 9 is less than that of the liquid storage layer 10, and a length of the second section well casing 2 is less than that of the third section well casing 3.

In step S3, a drill bit is drilled to the bottom of the gas storage layer 9, and a horizontal circular platform 15 is formed at the bottom of the gas storage layer 9. The second section sub-well casings are hoisted and placed into a drilled well section one by one from bottom to top, and the connecting between two second section sub-well casings is the prior art, and the second section well casing 2 also requires a conventional cementing operation.

Remaining second section sub-well casings are all opened at upper and lower ends, and only the second section sub-well casing at the bottom has a circular bottom surface, which is correspondingly placed on the circular platform 15 at the bottom of the gas storage layer 9. The circular platform 15 plays a role in supporting the second section well casings 2. The bottom surface of the second section sub-well casing at the bottom is closed except the drill-through hole 11, which can prevent the gas injected into the second section well casing 2 from leaking downwards, such that the gas in the second section well casing 2 can be only discharged into the gas storage layer 9 through the vent holes 7.

A diameter of a drill bit adopted in step S3 is greater than that of a drill bit adopted in step S5, that is, a diameter of the second section well casing 2 is greater than that of the third section well casing 3. In steps S3 and S5, the second section well casing 2 is concentrically arranged with the third section well casing 3 and the first section well casing 1. The drill bit adopted in step S5 starts to drill down from the drill-through hole 11 of at the bottom surface of the second section sub-well casing at the bottom to the bottom of the liquid storage layer 10, and the diameter of the drill bit adopted in step S5 is not greater than that of the drill-through hole 11. The third section sub-well casings are hoisted and placed into the drilled well section from bottom to top one by one, and then are installed on the ground in the second section well casing 2. The connection between the third section sub-well casings is the prior art, and the third section well casing 3 also requires a conventional cementing operation. In addition, a gap between an outer wall of the third section sub-well casing corresponding to the drill-through hole 11 and the edge of the drill-through hole 11 is sealed with the mud to prevent a gas in the second section well casing 2 from leaking from the gap, and the third section well casing 3 can be reinforced and supported at the drill-through hole 11. For the sealing between the third section well casing and the drill-through hole, a circle of sealing ring may also be arranged on the outer wall of the third section well casing corresponding to the drill-through hole in advance. After the third section sub-well casing is placed in place, the sealing ring just corresponds to the drill-through hole, and the sealing purpose can also be achieved.

In some embodiments, the structure of the second base 5 is the same as that of the first base 4. Specifically, the second base 5 includes a second base sleeve and a second hanging ring. The second base sleeve is a hollow cylinder. An axial direction of the second base sleeve is perpendicular to an inner wall of the third section sub-well casing. One end of the second base sleeve is provided with a circle of skirt edge extending outwards in a vertical direction. The skirt edge can be attached to the outer wall of the third section sub-well casing and is fastened to the outer wall of the third section sub-well casing by a bolt, thereby fastening the second base sleeve. The second hanging ring is in the second base sleeve and is installed on the outer wall of the third section sub-well casing.

In some embodiments, the gas-liquid separation component 12 is a helical flow tube which surrounds the inner wall of the third section well casing 3 in a helical pattern for multiple circles, and the top of each turn of the helical flow tube is provided with a hollowed-out vent slot 16 for venting gas after gas-liquid separation, and the vent slot 16 is arranged along the helical flow tube.

A liquid delivery pipe 14 is arranged at the wellhead of the third section well casing, which extends from the ground to the top of the helical flow tube and is connected with a water inlet at the top of the helical flow tube. Liquid on the ground is input into the helical flow tube through the liquid delivery pipe 14, and then flows downward along the helical flow tube, and a centrifugal force which is conducive to gas-liquid separation is generated. A separated gas is discharged from the vent slot 16, rises to the upper portion of the third section well casing 3, and then discharged from the top of the third section well casing 3. A bottom end of the helical flow tube is open for continuously draining the liquid into the third section well casing 3. A side surface, adjacent to the inner wall of the third section well casing 3, of the helical flow tube is provided with multiple struts to fasten the helical flow tube to the inner wall of the third section well casing 3.

For the problem of the gas-liquid two-phase combined geological storage, the second section well casing 2 and the third section well casing 3 nested inside and outside are designed. The second section well casing 2 extends to the bottom of the gas storage layer 9, the third section well casing 3 is arranged inside the second section well casing 2 and extends to the bottom of the liquid storage layer 10. The liquid is injected into the third section well casing through the wellhead of the third section well casing 3 or the liquid delivery pipe 14, the gas is injected into a region between the second section well casing 2 and the third section well casing 3 through the wellhead of the second section well casing 2 or the gas delivery pipe 13. The gas and the liquid are separated for respective injection without affecting with each other. The gas delivery pipe 13 is arranged in the wellhead of the second section well casing 2, and extends into the second section well casing 2 from the ground to connect gas delivery equipment.

According to the present disclosure, it is equivalent to saving the drilling cost of a portion, located in the second section well casing 2, of the third section well casing 3. However, as a portion of the third section well casing 3 is in the second section well casing 2, if it is only fixed at the ground and the drill-through hole 11, the stability of the third section well casing 3 will be reduced. In particular, the gas-liquid separation component 12 is arranged in the third section well casing 3, and the helical flow of the liquid will produce centrifugal force, so there is a higher requirement on the stability of the third section well casing 3. Multiple support rods 6 are arranged between the walls of the second section well casing 2 and the third section well casing 3 for supporting the third section well casing 3, and a method for arranging the support rod 6 is as follows.

(1) After cementing the second section well casing 2 in step S3, one traction rope 17 is configured for each support rod 6, a length of the traction rope 17 is greater than a corresponding spacing between the first base 4 and the second base 5 and is greater than a corresponding distance between the first base 4 and the ground. Hooks are respectively installed at both ends of the traction rope 17 for connecting the first hanging ring and the second hanging ring. A reel 18 is arranged at the middle of the traction rope 17 for temporarily adjusting the length of the traction rope 17.

(2) A manipulator 20 is installed at a bottom end of a retractable rod 21, and the retractable rod 21 is moved to a position right above the first base 4 to be operated, the manipulator 20 holds the hook at one end of the traction rope 17 and descends to the first base 4 along with the retractable rod 21, and the hook is hung into the first hanging ring by the manipulator 20.

A corresponding traction rope 17 is connected to the first base 4 on the inner wall of the second section well casing 2 according to a method in step (2).

(3) In step S5, the second bases 5 on the outer wall of the third section sub-well casings are in one-to-one correspondence with the first bases 4. Specifically, before hoisting a certain third section sub-well casing, the other hook of the traction rope 17 of the corresponding first base 4 is hung on the second hook of the corresponding second base 5, and the reel 18 unwinds to extend the traction rope 17.

The third section sub-well casing is hoisted into the second section well casing 2 to connect the third section sub-well casing that has been installed and positioned below, and under traction and guidance of the traction rope 17, a correct orientation can be maintained when lowering the third section sub-well casing, making the second bases 5 correspond to the first bases 4 one by one.

After installing all third section sub-well casings according to a method in step (3), all the hooks corresponding to the second bases 5 are removed by the manipulator 20 and the retractable rod 21 according to a method in step (2). One end, corresponding to the second base 5, of the traction rope 17 is recovered to the ground to form a free end, and then the third section well casing 3 is cemented;

(4) The support rod 6 is divided into multiple segments of sub-rods 19. The sub-rod 19 is a hollow barrel, and the free end of the traction rope 17 runs through the sub-rod 19 in an axial direction of the sub-rod 19 to hoist the sub-rod 19 to the corresponding first base 4 along the traction rope 17.

(5) remaining sub-rods 19 are lowered to adjacent sub-rods that have been connected in turns along the traction rope 17 according to a method of step (4), and the sub-rods 19 are connected in turn.

(6) A last sub-rod 19 is lowered in place along the traction rope 17 according to the method of step (4). After leveling the sub-rod 19, the manipulator 20 grips the sub-rod 19 to insert one end, away from the second base 5, of the sub-rod 9 into an open end of the adjacent sub-rod 19, then a hoisting rope and the traction rope 17 of the sub-rod 19 are cut off. The other end of the sub-rod 19 is inserted into the second base sleeve of the second base 5, and finally both ends of the sub-rod 19 are riveted or welded to the second base sleeve and the adjacent sub-rod 19.

The support rods 6 are installed from bottom to top according to the method described above.

In some embodiments, in step (1), the traction rope 17 is wound in the reel 18 in advance. The reel 18 is the prior art, that is, both sides of the reel 18 are respectively provided with an outlet, such that both ends of the traction rope 17 can extend out of the reel 18. The reel 18 is internally provided with a rotating shaft, which is connected with a motor. The redundant traction rope 17 is wound on the rotating shaft, and the motor drives the rotating shaft to rotate forward or backward, thus achieving the winding or unwinding of the traction rope 17.

In some embodiments, in step (2), operating the retractable rod 21 to ascend and descend is a conventional technology in the prior art. The manipulator 20 has the function of moving and rotating in three dimensions, and can move within a short distance and a small range. Each of the hook and hanging ring can be provided with a locking structure to avoid unhooking.

In some embodiments, in step (3), the second base 5 and the first base 4 are connected and positioned in advance by the traction rope 17 to avoid rotation dislocation of the third section sub-well casing in the hoisting process. In the process of descending the third section sub-well casing, the reel 18 gradually winds to make the traction rope 17 gradually shortened, thus preventing the traction rope 17 from prolapsing, and making the traction rope 17 always kept in a tight state.

Alternatively, in step (4), the free end of the traction rope 17 is hung on a hoisting device, the top of the sub-rod 19 is temporarily connected to the hoisting device by at least two hoisting ropes, and the manipulator 20 is prepositioned by the retractable rod 21 to a position beside the first base 4 to be connected.

The hoisting device releases the sub-rod 19 gradually, the sub-rod 19 falls to the position beside the first base 4 along the traction rope 17, and the hoisting device moves towards the center of circle of the second section well casing 2 on the ground, so that a part of a root of the traction rope 17 (i.e., a portion adjacent to the first base 4) is horizontal, and the sub-rod 19 is in a horizontal posture with the traction rope 17;

a gripper of the manipulator 20 grips the sub-rod 19 to insert the sub-rod 19 into the first base sleeve of the first base 4, and then the first base sleeve and the sub-rod 19 are riveted or welded, and the manipulator 20 cuts off the hoisting rope connected to the sub-rod 19.

Alternatively, in step (6), the other manipulator 20 can be lowered to cut off the hoisting rope and the traction rope 17, thus preventing the last sub-rod 19 from falling off. The open end of the adjacent branch rod 19 should be arranged to be slightly longer to allow an operation that the last sub-rod 19 is inserted into the open end first and then inserted into the second base sleeve in translation. After the support rod 6 is installed in sections, the corresponding traction rope 17 is left inside the support rod 6.

Further, alternatively, the support rods 6 in each section of the corresponding second section sub-well casing and third section sub-well casing are uniformly arranged in a circumferential direction of the second section well casing 2, and several rows are arranged up and down, depending on an actual situation.

The top of the third section well casing 3 is supported by the ground, and a lower portion of the third section well casing is supported by the drill-through hole 11 and a cementing material below, and the support rods 6 are uniformly distributed between the ground and the drill-through hole 11.

There is no support rod 6 in a region with the vent hole 7 of the second section well casing 2.

Alternatively, in step S6, the top of the third section well casing 3 is closed with a well lid or cement, with a position of the liquid delivery pipe 14 and a vent pipe reserved. The liquid delivery pipe 14 is arranged adjacent to the inner wall of the third section well casing 3, one end of the vent pipe communicates with the inside of the third section well casing 3, the other end of the vent pipe is connected to a gas delivery pipe 13 to input the gas separated in the third section well casing 3 into the second section well casing 2.

Alternatively, in step S6, the top of the second section well casing 2 is closed with cement of a cover plate to achieve a sealing effect, thereby preventing the gas in the second section well casing 2 from overflowing.

What is claimed is:

1. A drilling method for a storage well for liquid-gas two-phase combined geological storage, comprising following steps:

S1: drilling down from a ground to a bottom of a potable aquifer, placing a first section well casing, and carrying out cementing;

S2: dividing a second section well casing into a plurality of segments of second section sub-well casings, arranging a plurality of first bases on an inner wall of each of the plurality of segments of second section sub-well casings for installing support rods between an inner wall of the second section well casing and an outer wall of a third section well casing, wherein a sidewall of a second section sub-well casing, corresponding to a gas storage layer, of the plurality of segments of second section sub-well casings is uniformly provided with a plurality of vent holes for venting gas injected from the second section well casing into the gas storage layer; and a bottom surface of a second section sub-well casing, at a bottom, of the plurality of segments of second section sub-well casings is closed and is provided with a drill-through hole at a center of the bottom surface for the third section well casing to pass through;

S3: continuing to drill down through the first section well casing to a bottom of the gas storage layer, placing the second section well casing in the first section well casing, wherein the second section well casing extends to the bottom of the gas storage layer from the ground;

S4: dividing the third section well casing into a plurality of segments of third section sub-well casings, and arranging a plurality of second bases on an outer wall of each of the plurality of segments of third section sub-well casings for installing the support rods, wherein a gas-liquid separation component is arranged in any one of third section sub-well casings, at an upper portion of the third section well casing, of the plurality of segments of third section sub-well casings for gas-liquid separation of liquid injected from the third section well casing; a sidewall of one, corresponding to a liquid storage layer, of the plurality of segments of third section sub-well casings is uniformly provided with a plurality of drain holes for draining the liquid injected from the third section well casing into the liquid storage layer;

S5: continuing to drill down through the second section well casing to a bottom of the liquid storage layer, placing the third section well casing in the second section well casing, wherein the third section well casing extends to the bottom of the liquid storage layer from the ground, and outside a position where the third section well casing penetrates the drill-through hole, an outer wall of the third section well casing and an edge of the drill-through hole are sealed with mud;

corresponding the plurality of second bases on the outer wall of each of the plurality of segments of third section sub-well casings one-to-one with the plurality of first bases, and installing the support rods, wherein a method for arranging the support rods is as follows:

1) after cementing the second section well casing in step S3, configuring a traction rope for each of the support rods, respectively installing hooks at both end of the traction rope for connecting the first hanging ring and the second hanging ring, arranging a reel at a middle of the traction rope for temporarily adjusting a length of the traction rope;

2) installing a manipulator at a bottom end of a retractable rod, and moving the retractable rod to a position right above the first base to be operated, holding, by the manipulator, a hook, at one end of the traction rope, of the hooks, and descending the manipulator to the first base along with the retractable rod, and hanging, by the manipulator, the hook into the first hanging ring;

connecting corresponding traction ropes to the plurality of first bases on the inner wall of the second section well casing according to a method in step 2);

3) in step S5, enabling the plurality of second bases on an outer wall of each of the plurality of segments of third section sub-well casings to correspond to the plurality of first bases one by one, wherein before hoisting a predetermined third section sub-well casing of the plurality of segments of third section sub-well casings, hanging an other hook of the traction rope of a corresponding one of the plurality of first bases on the second hook of a corresponding one of the plurality of second bases:

hoisting the plurality of segments of third section sub-well casings into the second section well casing to connect one, that has been installed and positioned below, of the plurality of segments of third section sub-well casings, wherein under traction and guidance of the traction rope, a correct orientation is allowed to be maintained when lowering the plurality of segments of third section sub-well casings, making the plurality of second bases correspond to the plurality of first bases one by one; and after installing all the plurality of segments of third section sub-well casings according to a method in step 3), removing all the hooks corresponding to the plurality of second bases by the manipulator and the retractable rod according to the method in step 2), recovering one end of the traction rope corresponding to a corresponding one of the plurality of second bases to the ground to form a free end, and cementing the third section well casing;

4) dividing each of the support rods into a plurality of sub-rods, wherein each of the plurality of sub-rods is a hollow barrel, and enabling the free end of the traction rope to run through a corresponding one of the plurality of the sub-rods in an axial direction of the corresponding one of the plurality of sub-rods to hoist the corresponding one of the plurality of sub-rods to the corresponding one of the plurality of first bases along the traction rope;

5) lowering remaining sub-rods of the plurality of sub-rods to adjacent sub-rod that have been connected in turns along the traction rope according to a method of step 4), and connecting the plurality of sub-rods in turn; and 6) lowering a last sub-rod in place along the traction rope according to the method of step 4), after leveling the last one of the plurality of sub-rods, gripping, by the manipulator, the last sub-rod to insert a first end, away from the corresponding one of the plurality of the second bases, of the last sub-rod into an open end of the adjacent sub-rod, cutting off a hoisting rope and the traction rope of the last sub-rod, and inserting a second end of the last sub-rod into the second base sleeve of the corresponding one of the plurality of second bases, and riveting or welding both ends of the last sub-rod to the second base sleeve and the adjacent sub-rod; and S6: closing a top of the second section well casing, and reserving a position for a top of the third section well casing and at least one wellhead of the second section well casing; closing the top of the third section well casing, and reserving a position for a wellhead of the third section well casing.

2. The drilling method for the storage well for the liquid-gas two-phase combined geological storage according to claim 1, wherein each of the first bases comprises a first base sleeve and a first hanging ring, the first base sleeve is a hollow cylinder, an axial direction of the first base sleeve is perpendicular to an inner wall of a corresponding one of the plurality of segments of second section sub-well casings, one end of the first base sleeve is provided with a circle of skirt edge extending vertically outwards, the circle of skirt edge is allowed to be attached to the inner wall of a corresponding one of the plurality of segments of second section sub-well casings and is fastened to the inner wall of the corresponding one of the plurality of segments of second section sub-well casings by bolts, wherein the first base sleeve is fastened; and the first hanging ring is inside the first base sleeve and is installed on the inner wall of the corresponding one of the plurality of segments of second section sub-well casings.

3. The drilling method for the storage well for the liquid-gas two-phase combined geological storage according to claim 1, wherein a formation depth of the gas storage layer is less than formation depth of the liquid storage layer, and a length of the second section well casing is less than a length of the third section well casing;

a drill bit is drilled to the bottom of the gas storage layer, and a circular platform which is horizontal is formed at the bottom of the gas storage layer; the second section sub-well casing at the bottom has a circular bottom surface and is correspondingly placed on the circular platform at the bottom of the gas storage layer.

4. The drilling method for the storage well for the liquid-gas two-phase combined geological storage according to claim 2, wherein each of the plurality of second bases comprises a second base sleeve and a second hanging ring, the second base sleeve is a hollow cylinder, an axial direction of the second base sleeve is perpendicular to an inner wall of a corresponding one of the plurality of segments of third section sub-well casings, one end of the second base sleeve is provided with a circle of skirt edge extending vertically outwards, the circle of skirt edge is allowed to be attached to an outer wall of the corresponding one of the plurality of segments of third section sub-well casings and is fastened to the outer wall of the corresponding one of the plurality of segments of third section sub-well casings by bolts, wherein the second base sleeve is fastened; and the second hanging ring is inside the second base sleeve and is installed on the outer wall of the corresponding one of the plurality of segments of third section sub-well casings.

5. The drilling method for the storage well for the liquid-gas two-phase combined geological storage according to claim 1, wherein the gas-liquid separation component is a helical flow tube which surrounds an inner wall of the third section well casing in a helical pattern for a plurality of turns, and a top of each turn of the helical flow tube is provided with a hollowed-out vent slot for venting gas after gas-liquid separation, and the vent slot is arranged along the helical flow tube;

a liquid delivery pipe is arranged at a wellhead of the third section well casing, which extends from the ground to a top of the helical flow tube and is connected with a water inlet at the top of the helical flow tube; liquid on the ground is input into the helical flow tube through the liquid delivery pipe and flows downward along the helical flow tube, and a centrifugal force which is conducive to gas-liquid separation is generated; separated gas is discharged from the vent slot, rises to an upper portion of the third section well casing, and is discharged from the top of the third section well casing; and a bottom end of the helical flow tube is open for the liquid to be drained into the third section well casing continuously.

6. The drilling method for the storage well for the liquid-gas two-phase combined geological storage according to claim 1, wherein in step 3), the plurality of second bases and the plurality of first bases are connected and positioned in advance by the traction rope to avoid rotation dislocation of the third section sub-well casing in hoisting process; in process of descending the plurality of segments of third section sub-well casings, the reel gradually retracts to make the traction rope gradually shortened, wherein the traction rope is prevented from prolapsing and making the traction rope always kept in a tight state.

7. The drilling method for the storage well for the liquid-gas two-phase combined geological storage according to claim 6, wherein in step 4), the free end of the traction rope is hung on a hoisting device, a top of each of the plurality of sub-rods is temporarily connected with the hoisting device by at least two hoisting ropes, and the manipulator is pre-positioned by the retractable rod to a position beside the plurality of first bases to be connected;

the hoisting device releases the sub-rod gradually, the sub-rod falls to a position beside the plurality of first bases along the traction rope, the hoisting device moves towards a center of circle of the second section well casing on the ground, making a part of a root of the traction rope horizontal, and the sub-rod is further in a horizontal posture with the traction rope;

a gripper of the manipulator grips the sub-rod to insert the sub-rod into the first base sleeve of a corresponding one of the plurality of first bases, the first base sleeve and the sub-rod are riveted or welded, and the hoisting rope connected with the sub-rod is cut off by the manipulator.

8. The drilling method for the storage well for the liquid-gas two-phase combined geological storage according to claim 5, wherein in step S6, the top of the third section well casing is closed with a well lid or cement, and a position for the liquid delivery pipe and a position for a vent pipe is reserved; the liquid delivery pipe is arranged adjacent to the inner wall of the third section well casing, a first end of the vent pipe communicates with an inside of the third section well casing, and a second end of the vent pipe is connected with a gas delivery pipe to input separated gas in the third section well casing into the second section well casing; and the top of the second section well casing is closed with cement or a cover plate to achieve a sealing effect, wherein the gas in the second section well casing is prevented from overflowing.

* * * * *